US005742002A

United States Patent [19]

Arredondo et al.

[11] Patent Number: 5,742,002

[45] Date of Patent: Apr. 21, 1998

[54] AIR-DIELECTRIC COAXIAL CABLE WITH HOLLOW SPACER ELEMENT

[75] Inventors: James M. Arredondo, Oak Forest; Thomas A. Fleisher, Chicago Heights; James A. Krabec, Oak Lawn; James R. Gentile, Chicago, all of Ill.

[73] Assignee: Andrew Corporation, Orland Park, Ill.

[21] Appl. No.: 504,893

[22] Filed: Jul. 20, 1995

[51] Int. Cl.[6] ..... H01B 7/02

[52] U.S. Cl. ..... 174/29; 174/102 D; 174/113 AS; 174/116; 174/126.3

[58] Field of Search ..... 174/28, 29, 102 D, 174/113 AS, 116, 126.3

[56] References Cited

U.S. PATENT DOCUMENTS

| | | | |
|---|---|---|---|
| 1,978,418 | 10/1934 | Dudley | 174/29 |
| 2,035,274 | 1/1936 | Mougey | 174/29 |
| 2,381,003 | 8/1945 | Ryan | 174/29 |
| 2,556,244 | 6/1951 | Weston | 174/29 |
| 3,126,438 | 3/1964 | Lorrin | 174/29 |
| 3,227,800 | 1/1966 | Bondon | 174/29 |
| 3,514,523 | 5/1970 | Hildebrand et al. | 174/28 |
| 3,748,373 | 7/1973 | Remy | 174/115 |
| 3,750,058 | 7/1973 | Bankert, Jr. et al. | 333/95 R |
| 3,789,129 | 1/1974 | Ditscheid | 174/29 |
| 3,864,509 | 2/1975 | Gommans | 174/28 |
| 4,018,977 | 4/1977 | Herrmann, Jr. et al. | 174/29 |
| 4,092,485 | 5/1978 | Wanser | 174/102 D |
| 4,132,855 | 1/1979 | Clark et al. | 174/28 |
| 4,145,565 | 3/1979 | Donon | 174/28 |
| 4,190,733 | 2/1980 | Wootton | 174/28 |
| 4,246,937 | 1/1981 | Müller | 138/108 |
| 4,487,660 | 12/1984 | Netzel et al. | 174/28 |
| 4,758,685 | 7/1988 | Pote et al. | 174/29 |
| 4,767,890 | 8/1988 | Magnan | 174/28 |
| 4,987,274 | 1/1991 | Miller et al. | 174/102 R |
| 5,130,497 | 7/1992 | Yoshikawa | 174/28 |
| 5,196,078 | 3/1993 | Pote | 156/52 |
| 5,262,593 | 11/1993 | Madry et al. | 174/102 R |
| 5,286,923 | 2/1994 | Prudhon et al. | 174/29 |

FOREIGN PATENT DOCUMENTS

| | | | |
|---|---|---|---|
| 694986 | 7/1953 | United Kingdom | 174/29 |
| 817065 | 7/1959 | United Kingdom | 174/29 |
| 1022847 | 3/1966 | United Kingdom | 174/29 |

*Primary Examiner*—Kristine L. Kincaid
*Assistant Examiner*—Marc Machtinger
*Attorney, Agent, or Firm*—Arnold, White & Durkee

[57] ABSTRACT

A coaxial cable having coaxial inner and outer conductors which are separated by a helix of solid dielectric material. The helix extends through the annular space between the inner and outer conductors, and the helix is wound around the inner conductor. The inner edge of the helix engages the inner conductor and the outer edge of the helix engages the outer conductor. The outer edge of the helix forms multiple notches along the length of the helix, and the body of the helix is hollow.

6 Claims, 2 Drawing Sheets

AIR-DIELECTRIC COAXIAL CABLE WITH HOLLOW SPACER ELEMENT

FIELD OF THE INVENTION

The present invention relates generally to coaxial cables, more particularly, to air-dielectric cables in which the inner and outer conductors are held in the desired concentric relationship by a solid-dielectric spacer element in the region between the inner and outer conductors.

SUMMARY OF THE INVENTION

It is a primary object of the present invention to provide an improved air-dielectric coaxial cable containing a solid-dielectric spacer element which can be made of a relatively lossy material without excessively increasing the loss characteristics of the cable.

It is another object of this invention to provide such an improved air-dielectric coaxial cable in which the solid-dielectric spacer element can be made of a material which permits the cable to be used at relatively high power levels.

A further object of this invention is to provide such an improved air-dielectric coaxial cable in which the inner and outer conductors are reliably maintained in a stable physical relationship to each other.

Yet another object of this invention is to provide such an improved air-dielectric coaxial cable which can be efficiently and economically manufactured in long lengths.

Other objects and advantages of the invention will be apparent from the following detailed description and the accompanying drawings.

In accordance with the present invention, the foregoing objectives are realized by providing an air-dielectric coaxial cable in which the inner and outer conductors are separated by a helix of solid dielectric material extending through the annular space between the inner and outer conductors. The helix is wound around the inner conductor with the inner edge of the helix engaging the inner conductor and the outer edge of the helix engaging the outer conductor. The body of the helix is hollow, and the outer edge of the helix forms multiple notches along the length of the helix. This construction enables the solid dielectric material to be made of a fluoropolymer or other solid dielectric material which has a relatively high softening temperature, which in turn permits the cable to be used at relatively high power levels. Although such materials typically have relatively high loss characteristics, the amount of material required in the cable of the present invention is sufficiently small that the overall loss of the cable is not excessively increased.

In the preferred embodiment of the invention, the helix of solid dielectric material includes one or more interior ribs which extend longitudinally through the hollow interior to reinforce the hollow helix. The notches along the outer edge of the helix also preferably increase in width from the outer edge of the helix toward the inner edge of the helix, so as to provide a relatively wide support surface along the outer edge of the helix, while reducing the amount of solid dielectric material required in the central portion of the helix.

DETAILED DESCRIPTION OF THE PREFERRED EMBODIMENT

Figure 1:
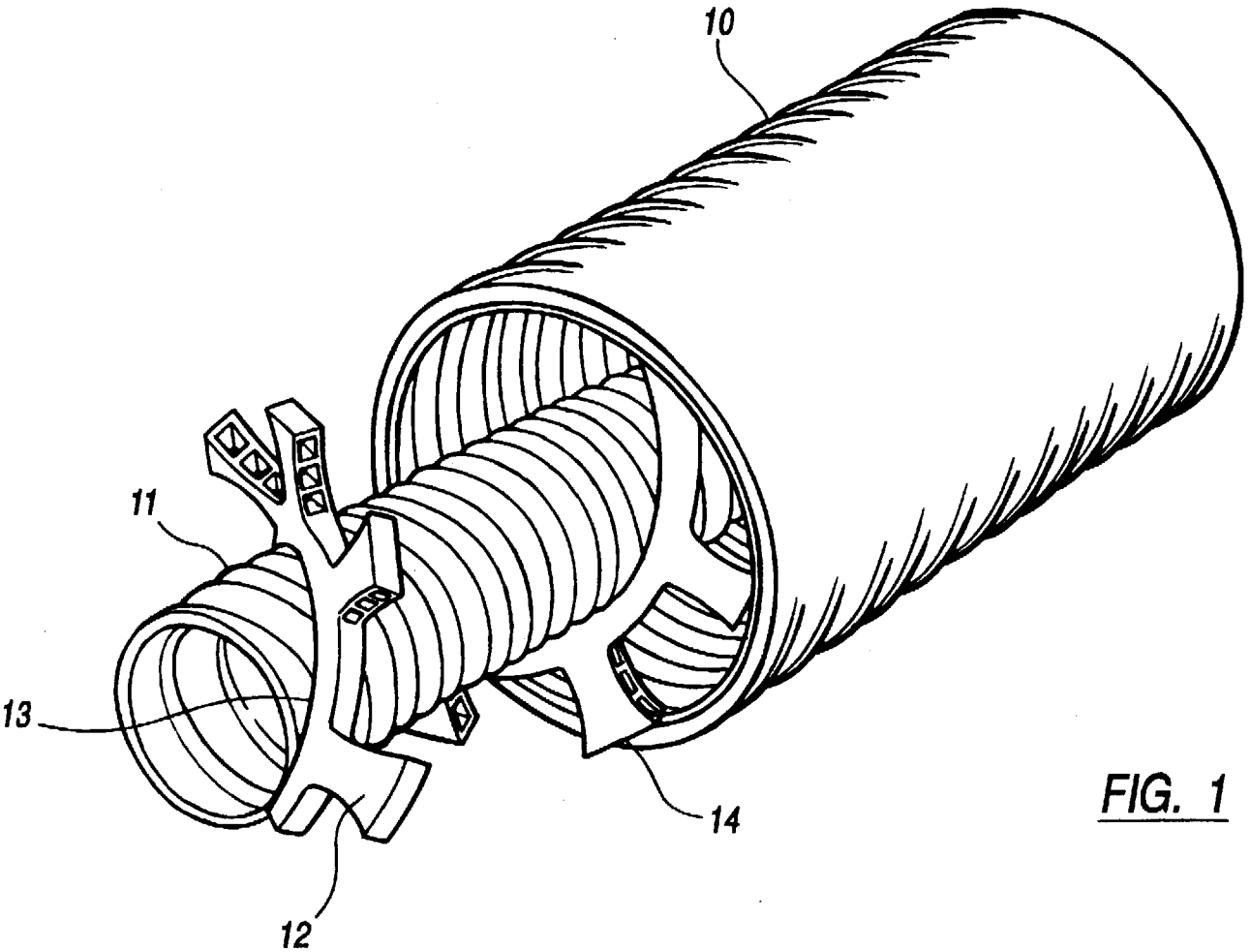
FIG. 1 is a perspective view of a coaxial cable embodying the present invention, with portions thereof broken away to show the internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appending claims.

Turning now to the drawings, there is shown a coaxial cable having a helically corrugated outer conductor 10 concentrically spaced from a hollow, helically corrugated inner conductor 11 by a solid-dielectric spacer 12. Although the cable has been illustrated with helically corrugated inner and outer conductors, corrugations in either or both of these elements may be annular rather than helical. As is well known to those familiar with this art, a helically corrugated conductor is distinguished from an annularly corrugated conductor in that the helical corrugations form a continuous pattern of corrugation crest and roots along the length of the cable such that each crest is opposite a root along the circumference of the conductor. Consequently, any transverse cross-section taken through the conductor perpendicular to its axis is radially asymmetrical, which is not true of annularly corrugated conductors.

As can be seen in FIG. 1, the solid-dielectric spacer 12 is in the form of a helix or spiral which is wound around the inner conductor 11 with the inner edge 13 of the helix engaging the inner conductor 11 and the outer edge 14 of the helix engaging the outer conductor 10. The helix is sufficiently rigid in the radial direction that the inner and outer conductors 11 and 10 are reliably held in the desired concentric relationship to each other. Because of the tight frictional engagement of the helix with both the inner and outer conductors, the two conductors are also held against longitudinal movement relative to each other.

Figure 3:
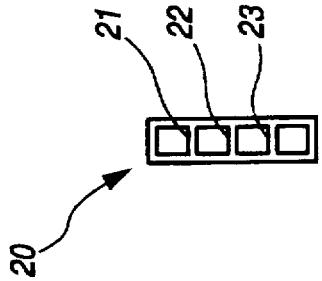
FIG. 3 is end elevation of the extruded dielectric strip shown in FIG. 2.

The solid-dielectric helix is formed from an extrusion 20 having the cross-sectional configuration illustrated in FIG. 3. It can be seen that the extrusion is a hollow rectangle subdivided internally by three longitudinal ribs 21, 22 and 23 which reinforce the long walls of the rectangle. This constructions uses a relatively small amount of solid-dielectric material, and yet has sufficient rigidity to maintain the desired concentric relationship of the inner and outer conductors when the extrusion is wound around the inner conductor 11 to form the desired helical spacer element.

To permit the extrusion to be wound into a helix, and at the same time further reducing the amount of solid dielectric material, repetitive notches 24 are formed in one longitudinal edge of the extrusion. Each notch 24 increases in width from the open end of the notch toward the closed end of the notch. Conversely, the finger 25 of solid dielectric material that remains between each pair of adjacent notches 24 increases in width from the closed end of the notches 24 to the outer edge of the helical strip. The longitudinal dimension of the outer end of each of these fingers 25 is preferably at least as long as the distance between two adjacent inner crests of the corrugations in the outer conductor 10, along the helical path of the spacer element. This prevents the outer ends of the fingers 25 from entering into the troughs of the corrugations in the outer conductor 10, so that the outer ends of the fingers 25 always rest on the inner crests of the corrugations of the outer conductor. This further ensures the desired concentric relationship between the inner and outer conductors 11 and 10.

Figure 2:
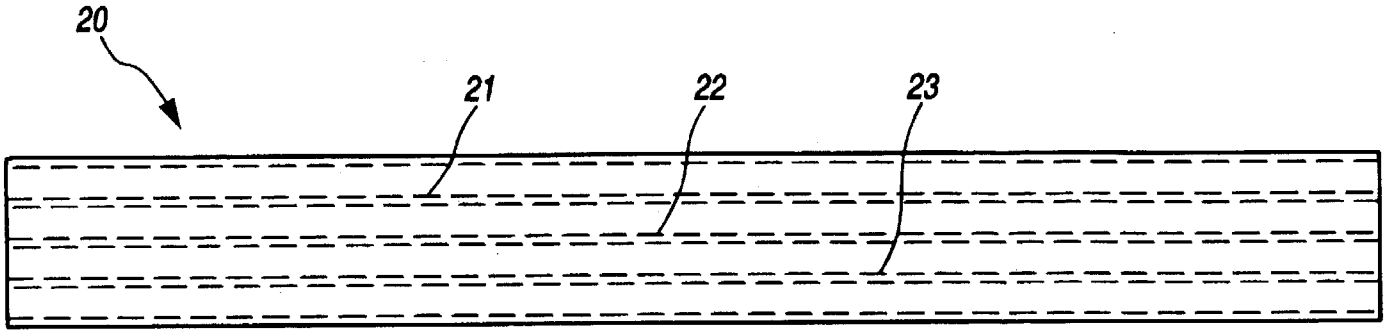
FIG. 2 is a plan view of an extruded dielectric strip used to make the solid-dielectric spacer element in the cable of FIG. 1.
Figure 4:
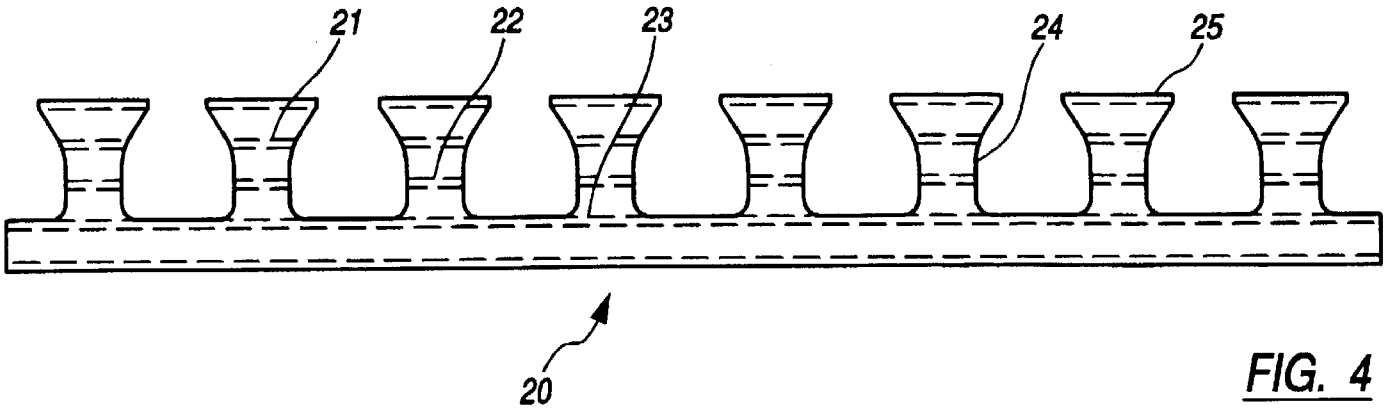
FIG. 4 is a plan view of a portion of the solid-dielectric spacer element in the cable of FIG. 1, formed from the strip of FIGS. 2 and 3.

The solid-dielectric helix illustrated in FIGS. 1–3 can be made of a fluoropolymer such as Teflon which has a sufficiently high softening temperature and melt temperature to enable the cable to be used in relatively high-power applications. The preferred fluoropolymers are those that soften at temperatures above 200° C., and even more preferably above about 300° C. Because of the relatively small amount of solid-dielectric material required to form the illustrative helix, the cable still has relatively low loss and attenuation characteristics, even when the helix is made of a fluoropolymer which has a relatively high molecular weight and relatively high electrical loss characteristics per unit volume.

We claim:

1. A coaxial cable comprising coaxial inner and outer conductors separated by a single helix of dielectric material extending through an annular space between the inner and outer conductors, said helix being wound around the inner conductor with an inner surface of the helix engaging the inner conductor and portions of an outer surface of the helix along an outer edge of the helix engaging the outer conductor, the portions of the outer surface being separated along a length of the helix by multiple notches which are recessed from the outer conductor along the length of the helix and the helix having a hollow interior which is divided by a plurality of interior ribs extending longitudinally through said hollow interior to reinforce the helix, the helix being substantially rigid in a radial direction between said inner and outer conductors and the inner surface and the portions of said outer surface that engage said inner and outer conductors being substantially solid surfaces.

2. The coaxial cable of claim 1 wherein said notches increase in width, along the length of the helix, from the outer edge of the helix toward the inner surface of the helix.

3. The coaxial cable of claim 2 wherein said outer conductor is corrugated, and the portions of the outer surface of the helix between adjacent ones of said notches which engage the outer conductor are at least as long as a distance between adjacent corrugation peaks in the outer conductor along the outer edge of the helix.

4. The coaxial cable of claim 1 wherein both the inner conductor and the outer conductor are corrugated.

5. The coaxial cable of claim 1 wherein said dielectric material is a fluoropolymer.

6. The coaxial cable of claim 1 wherein the inner surface of the helix forms a continuous surface along the length of the helix for engaging an outer surface of the inner conductor.

* * * * *